United States Patent [19]

Haubner et al.

[11] 3,951,122

[45] Apr. 20, 1976

[54] IGNITION SYSTEM FOR INTERNAL COMBUSTION ENGINE AND METHOD TO GENERATE IGNITION PULSES

[75] Inventors: Georg Haubner, Berg; Kurt Zimmermann, Ludwigsburg, both of Germany

[73] Assignee: Robert Bosch G.m.b.H., Gerlingen-Schillerhohe, Germany

[22] Filed: June 18, 1974

[21] Appl. No.: 480,581

[30] Foreign Application Priority Data

July 7, 1973 Germany ..... 2334610

[52] U.S. Cl. ..... 123/148 CC; 123/148 E

[51] Int. Cl.[2] ..... F02P 1/17

[58] Field of Search ..... 123/148 MC

[56] References Cited

UNITED STATES PATENTS

| | | | |
|---|---|---|---|
| 3,367,314 | 2/1968 | Hirosawa et al. | 123/148 MC |
| 3,447,521 | 6/1969 | Piteo | 123/148 MC |
| 3,515,109 | 6/1970 | Farr | 123/148 MC |
| 3,524,438 | 9/1970 | Janisch | 123/148 MC |
| 3,630,185 | 12/1971 | Strubel et al. | 123/148 MC |
| 3,768,455 | 10/1973 | Imhof | 123/148 MC |
| 3,791,363 | 2/1974 | Schmaldienst | 123/148 MC |

*Primary Examiner*—Wendell E. Burns
*Assistant Examiner*—James W. Cranson, Jr.
*Attorney, Agent, or Firm*—Flynn & Frishauf

[57] ABSTRACT

To prevent phase-shift and pulse retardation in capacitor ignition systems, supplied with pulses from an a-c generator, the ignition capacitor is included in the armature circuit of the magneto to form, with the armature, an oscillatory circuit; the magneto supplies temporally spaced pulsed of opposite polarity, the first pulse causing oscillation of the oscillatory capacitor-armature circuit which, upon the first oscillation swing, recharges the capacitor with opposite polarity so that the next pulse derived from the magneto will add to the charge placed on the capacitor by the first oscillatory swing, thus preventing spark retardation due to phase shift upon change in engine speed.

15 Claims, 6 Drawing Figures

IGNITION SYSTEM FOR INTERNAL COMBUSTION ENGINE AND METHOD TO GENERATE IGNITION PULSES

The present invention relates to an ignition system for internal combustion engines, and more particularly to an ignition system in which an a-c magneto provides electrical energy which is applied to an ignition capacitor which is discharged over an ignition coil by a trigger switch, typically a semiconductor element, the secondary of the ignition coil being connected to a spark plug.

Magneto ignition systems require that the timing of the ignition spark, that is, the instant of ignition, changes within narrow limits even though the speed of the engine may vary widely over wide ranges. In a known ignition system, utilizing a magneto and an ignition capacitor, the ignition capacitor is connected directly to the charge winding of an a-c generator, and is discharged by means of a thyristor over the primary winding of the ignition coil. The control electrode of the thristor is connected to a tap point of the a-c generator charge winding. The capacitor and the charge winding together form an oscillatory or tank circuit. The induced sinusoidal alternating voltage, induced in the charge winding of the a-c generator, that is, the magneto, is applied to the capacitor. The capacitance of the capacitor and the inductance of the a-c winding together determine the time constant of the oscillatory circuit. As the speed of the internal combustion engine increases, the charging of the capacitor is delayed with respect to the position of the crankshaft of the engine. Thus, as the speed increases, the ignition is increasingly retarded, and may be retarded to an unacceptable extent.

It has already been proposed to attempt to avoid the retardation of the spark by using the negative half-wave of the sinusoidal alternating current by triggering a Zener diode, properly polarized, by the negative half-wave. The Zener diode is connected to the ignition triggering thyristor, and senses the voltage across the ignition capacitor. When the ignition capacitor reaches a predetermined voltage, the Zener diode becomes conductive, thus triggering the thyristor to switch over into conductive stage, permitting discharage of the ignition capacitor through the ignition coil. Since only a half-wave is used, a diode is necessary to isolate the negative half-wave from the ignition power circuit. This charge diode is an additional element which introduces costs, since it must have a high voltage breakdown resistance. The negative half-wave from the a-c generator is not loaded, and may thus reach high values. This charge diode must be capable of resisting such high values; it may require additional circuit components in order to provide for voltage limitation across the diode in blocking direction.

It is an object of the present invention to provide a capacitor, semiconductor controlled ignition system in which the spark delay, with increasing speed of the engine, is avoided and which does not require additional, expensive circuit components.

SUBJECT MATTER OF THE PRESENT INVENTION

Briefly, the capacitor and the a-c generator providing power for the ignition, are connected in such a manner that, at each full revolution of the rotor of the generator, the capacitor has at least two spaced pulsed applied thereto, induced in the armature winding of the a-c generator, and forming voltage half-waves which are of opposite polarity. The first voltage half-wave is selected to have a lower amplitude than the second voltage half-wave (of opposite polarity); the second voltage half-wave is actually used to supply power for ignition.

In accordance with a feature of the invention, the capacitor and the winding of the a-c generator form, together, a tank circuit which starts to oscillate when the first voltage half-wave is applied so that when the second voltage half-wave arises, the capacitor has been re-charged in opposite direction due to the oscillatory effect resulting from its connection to the charge winding.

In a preferred embodiment of the invention, the two half-waves from the a-c generator are so timed with respect to each other, and so matched to each other, that the capacitor, which forms with the charge winding an oscillatory, or tank circuit, is pre-charged by the first, smaller charge half-wave which, in the tank circuit, then effects reversal and re-charge in the opposite direction, the re-charge time in the opposite direction falling at least in part in the time interval allocated to the second charage half-wave from the a-c generator.

The operating reliability of the ignition system is improved by so arranging the armature that a third half-wave is generated, of opposite polarity to the second (that is, of same polarity as the first) and having a smaller amplitude than the second, for example the same amplitude as the first half-wave.

The invention will be described by way of example with reference to the accompanying drawings, wherein.

Figures 3A, 3B, 3C:
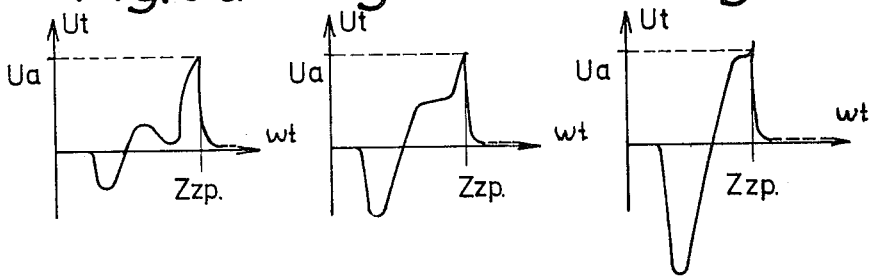
Figure 4:
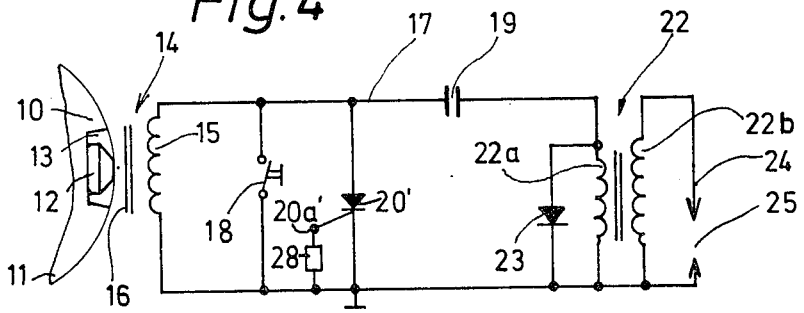

FIG. 3, shown separately as FIG. 3*a*, FIG. 3*b* and FIG. 3*c*, illustrates the voltage relationship at the ignition capacitor, in which FIG. 3*a* shows the relationship at low engine speed; FIG. 3*b* in intermediate engine speed; and FIG. 3*c* at high engine speed; and FIG. 4 illustrates an a-c ignition system in which the primary winding of the ignition transformer forms part of the inductance of the tank circuit.

The capacitor discharge ignition system (FIG. 1) is illustrated for a one-cylinder internal combustion engine (not shown). The engine drives a flywheel 11 which includes a permanent magnet 12, to form a permanent field. Permanent magnet 12 has two pole shoes 13, 13 located, spaced from each other, along the circumference of flywheel 11. Pole shoes 13 cooperate with a stator armature 14, having a generally E-shaped magnetic circuit, on which an armature winding 15 is wound. Winding 15 is located on a central leg 16*a* of the E-shaped core 16. The outer legs of core 16 are directed towards the flywheel 11 and so shaped that, in predetermined positions of the flywheel, two adjacent legs of the iron core 16 are opposite the pole shoes of the magnet 12. One end of charge winding 15 is connected to chassis, or ground; the other end is connected to a charge line 17. A shorting switch 18 is connected across line 17 and chassis. The ignition capacitor 19 is connected in parallel to the armature winding 15, that is, is connected across line 17 and chassis. Ignition capacitor 19 is bridged by a discharge circuit which includes a thyristor 20, forming an electronic switch, connected in series with a diode 21, and the primary winding 22*a* of an ignition coil or ignition transformer 22. A further diode 23 is connected in parallel to primary winding 22*a*. The cathode of diode 23 and the other terminal of the ignition coil winding 22*a* are likewise connected to chassis. The secondary 22*b* or ignition coil 22 is ignition coil 22 is connected over ignition cable 24 to a spark plug 25. The control electrode 20*a* of the thyristor is connected over a voltage-sensitive element 26 and a current-limiting resistor 27 with the charge line 17. In a preferred form, the voltage-sensitive element 26, forming the voltage-sensitive switch, is an avalanche diode. The avalanche diode 26 is connected with the ignition capacitor 19 at the cathode thereof. The anode of thyristor 20 is likewise connected to the capacitor 19. Basically, therefore, the system comprises an a-c generator 10, having an armature winding system 14, including a coil 15, and a capacitor 19, coil and capacitor being connected in an oscillatory circuit.

Figure 2:
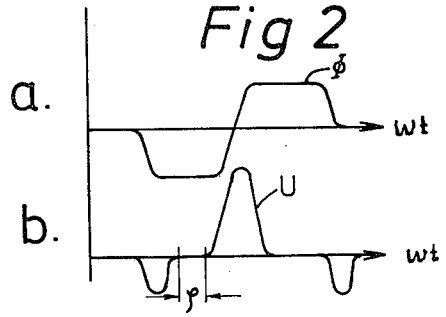
FIG. 2 is a graph illustrating flux (graph a) and voltage U (graph b), with respect to time, or circumferential rotor position, respectively.

Operation, with reference to FIGS. 2 and 3: The upper graph (a) of FIG. 2 illustrates the relationship of the flux $\Phi$ with respect to time $\omega t$. This is the flux derived from permanent magnet 12 and linking the charge winding 15, generated upon rotation of the flywheel 11. The lower graph (b) illustrates the no-lead voltage at the armature winding 15, with respect to rotation (time), that is, $\omega t$. Graph (b) thus illustrates the voltage half-waves resulting from the respective change of flux.

At each full rotation of the flywheel 11, the generator 10 will induce the first and negative voltage half-wave of low voltage. Thereafter, a period of no voltage follows, which extends over an angle of rotation $\phi$ of flywheel 11. Then a positive voltage half-wave of high amplitude follows and, after a further period at no voltage, a second negative voltage half-wave of low amplitude will follow. The angle of rotation $\phi$, which the flywheel 11 spans between the first and second voltage half-waves corresponds to a time duration which decreases, in proportion, with increasing speed of the engine, and hence of the flywheel 11.

The distance, in time, between the voltage pulses controls the operation of the ignition system described in connection with FIG. 1. At the first, small voltage half-wave, ignition capacitor 19 is first charged in a negative direction. Since it forms a tank or oscillatory circuit with the armature winding 15, it re-charges in the opposite direction as the first voltage half-wave dies down. Referring to FIG. 3*a*: The re-charge of the ignition capacitor 19 already decreases, at low speeds, in that time interval in which the voltage induced by generator 10 is almost zero. Re-charge of the capacitor thus has no effect on the subsequent following charge half-wave, which has a substantially higher voltage value and charges the capacitor to a higher value. When a certain trigger voltage $U_a$ is reached, the avalanche diode 26 interrupts further charging of the capacitor 19, since the avalanche diode 26 abruptly becomes conductive and renders the switching circuit of thyristor 20 conductive by conducting a pulse over resistor 27 to the gate of the thyristor 20. At this time instant, that is, at the ignition time instant Zzp, capacitor 19 abruptly discharges over its discharge circuit, that is, over the low-resistance path of the thyristor 20, diode 21 and primary winding 22*a* of the ignition coil, or transformer 22. The secondary winding 22*b* of the ignition coil 22 will receive a high voltage pulse which causes a spark to occur at spark plug 25, by conducting the pulse over cable 24. The spark time is extended in the system, since the armature winding 15 continues to provide electrical energy immediately after discharge of the capacitor 19 to the primary 22*a* of the ignition coil 22. This leads to additional voltage transformation in the secondary 22*b*, and thus, due to the increased supply of energy, extends the spark time of the spark plug. The spark gap, once having broken down, requires lesser voltage for continued operation than for the initial breakdown and for the first spark.

In an intermediate region of operating speed — as illustrated in FIG. 3*b* — the negative half-wave has increased. The re-charging of the capacitor 19 also occurs in the time interval between the first and the second voltage half-wave from armature winding 15. The ignition capacitor 19 is, however, already somewhat pre-charged when the positive voltage half-wave occurs, and the charge voltage at the capacitor 19 rises rapidly to reach the response or trigger voltage $U_a$ of the avalanche diode 26. Capacitor 19 then discharges as above described. The ignition timing has not changed with respect to that described in FIG. 3*a*, that is, there is no spark delay, in spite of increasing speed, since the capacitor has already a higher re-charge, that is, it is already pre-charged.

The prior negative voltage half-wave — as seen in FIG. 3*b* — increases further and, thus, the capacitor in combination with the armature coil 15 will have a higher pre-charge arise thereat, as the speed increases. As seen in FIG. 3*c*, the pre-charged capacitor 15 is practically completely charged by the re-charging, due to the connection in the oscillatory circuit, and the trigger voltage $U_a$ of the avalanche diode 26 is reached immediately as the second positive voltage half-wave occurs. There is no shift, towards retardation, of the ignition instant Zzp, since the phase shift, due to increased speed, of the positive half-wave has been compensated by the pre-charging of the ignition capacitor, upon re-charging in opposite direction due to its inclusion in the oscillatory circuit.

Figure 1:
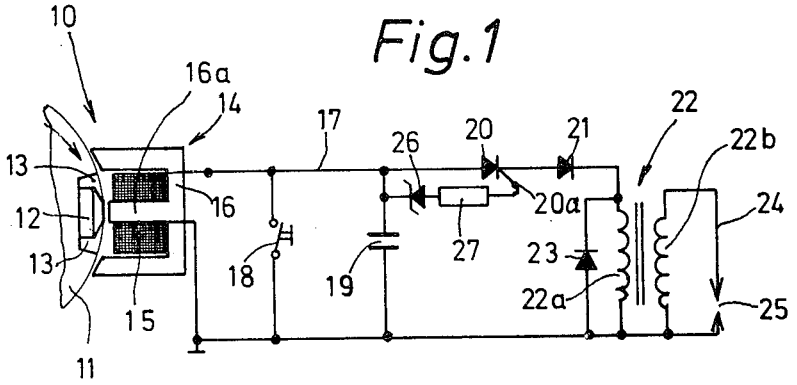
FIG. 1 is an a-c ignition system including an oscillatory circuit formed of a charge winding and a capacitor.

The third negative voltage half-wave of smaller amplitude, and following the positive second charging or power half-wave, has to functions in the circuit of FIG. 1: (1) The thyristor is reliably returned to blocking condition, even at high speed. The negative half-wave effects charging of the ignition capacitor 19 in negative direction, so that the voltage at the cathode of the thyristor will become positive, and at its anode negative, thereby quickly removing any remanent charge carriers and returning the thyristor to blocked condition. (2) The negative half-wave prevents rotation of the engine in the wrong direction. If the engine would operate in the wrong direction, this small amplitude would become positive, and the half-wave prevents switching over of the thyristor 20 to conductive state, for example if the internal combustion engine should, itself, oscillate and briefly go into reverse direction of rotation. At higher speeds, for example if the ignition system is used with a hand-starting arrangement, for example a pull cord, spring, or the like, and the engine should inadvertently swing into wrong operating direction, ignition would occur so early that the internal combustion engine cannot continue to operate under its own power.

The diode 21, connected in series with thyristor 20, protects the thyristor 20 against excessively high blocking voltages which may arise if the system is connected to a magneto 10 of excessive power, or excessive magnetic strength, and which might charge the capacitor 19, in higher speed ranges, to an excessively high negative voltage. If the magneto generators used with the engine are of low power, and low magnetism, diode 21 may be omitted.

The engine is stopped by closing the stop switch 18, for example manually, thereby shorting the armature winding 15 of the generator 10. This removes electric energy from the charge capacitor 19 and thus interrupts ignition at the spark plug 25.

Embodiment of FIG. 4: The circuit, in general, is similar, and similar elements operating similarly have been given the same reference numerals and will not be described again in detail. The main difference in the circuit of FIG. 4 with respect to that of FIG. 1 is this: Capacitor 19 forms a tank or oscillatory circuit not only with the armature winding 15, but also with the primary 22*a* of ignition transformer 22. The primary 22*a* is bridged by diode 23 which, however, is poled oppositely to the diode 23 of FIG. 1, so that it will pass higher positive charging half-waves (see FIG. 2). The thyristor is preferably a planar thyristor 20', having a gate electrode 20'*a* connected by means of a resistor 28 with the cathode thereof, which is likewise connected to ground or chassis. The planar thyristor 20' has the property that it can, itself, switch into conductive state when the voltage at its anode reaches a certain value with respect to its cathode. It forms what might be termed a bootstrap circuit. Resistor 28 at the gate electrode is provided so that when planar thyristor 20' blocks, charge carriers are quickly drawn off.

Operation of circuit of FIG. 4: Basically, the operation is similar to that described in connection with FIG. 1. Magnetic flux, as well as the voltage U at the armature winding 15 are identical to that described in connection with FIG. 2. The charge capacitor 19 is first charged by the first negative small voltage half-wave, over primary winding 22*a* of ignition transformer 22. This charge on the capacitor, in the oscillatory circuit, oscillates over diode 23 and charge winding 15 to repolarize capacitor 19. The subsequent positive higher charge half-wave now charges capacitor 19 to the trigger voltage $U_a$. Planar thyristor 20' triggers, automatically, and capacitor 19 discharges over the main or switching circuit of planar thyristor 20' and primary 22*a*. This abrupt discharge causes a high voltage pulse in the secondary 22*b* of ignition coil 22, and causes ignition at spark plug 25. The ignition capacitor 19 is in series connection with the primary 22*a* of ignition coil 22, since the planar thyristor 20' is in parallel to the armature winding 15. The ignition timing of the spark at spark plug 25 is not extended since the electrical energy supplied from the magneto 14 is short-circuited by the planar thyristor 20'.

The charge voltages at the ignition capacitor 19 in the lower, middle and high speed ranges, in general, are similar to those shown in the graphs of FIG. 3*a*, 3*b*, 3*c*.

Various modifications and changes may be made within the scope of the inventive concept. The magneto generator may have any known and suitable construction. It is of primary importance for the invention, however, that the charge half-wave which is used to charge the capacitor, for discharge through the ignition coil and to supply ignition energy, is actually the second pulse, that is, follows a reversely poled voltage half-wave which, by inclusion of the capacitor in an oscillatory circuit, pre-charges capacitor 19 even before the real charge half-wave occurs. In its simplest form, the circuit is realized by constructing the magneto generator in such a manner that its armature winding is located on the center leg of an E-shaped core. Different types of power sources or magnetos may be used, combined with wave-shaping or pulse-shaping circuits so that the eventual output pulses or waves derived from the power source will, essentially, be similar to the voltage U of graph (*b*) of FIG. 2.

We claim:

1. Ignition system in combination with an internal combustion engine having a charge capacitor (19), an ignition transformer (22) and a controlled switch (20,20'), said controlled switch having its main switching path connected to discharge the capacitor (19) through the primary of the ignition transformer (22), the controlled switch being triggered into conduction when the voltage across the capacitor reaches a predetermined level;

inductive means (15, 22) connected to the capacitor (19) to form therewith an oscillatory circuit;

and means (12, 13, 16) applying to said oscillatory circuit, including said capacitor (19), for each revolution of the engine, a sequence of temporally spaced pulses of respective alternating polarity, in which the first pulse is of a level insufficient to raise the voltage across the capacitor to the level which triggers the controlled switch into conduction, said first pulse setting the oscillatory circuit into oscillation and effecting re-charging of the capacitor in opposite direction;

and in which the second pulse of opposite polarity has a higher amplitude than the first, the energy of the second pulse being added to the pre-charge on the now reversely recharged capacitor to provide a voltage level across the capacitor sufficient to trigger the controlled switch into conduction and to discharge the charge on the capacitor through the ignition transformer.

2. System according to claim 1, wherein the means supply the sequence of temporally spaced pulses to said oscillatory circuit comprises an a-c generating means including a rotary magnet (12, 13) driven by the engine and a fixed armature coil (15), in magnetic circuit relation to the field, the armature coil forming at least part of said inductive means.

3. System according to claim 1, wherein the temporal spacing of the pulses is selected to effect at least partly reversely charging of the capacitor in the oscillatory circuit upon termination of the first pulse and during the interval between the first and second pulses.

4. System according to claim 1, wherein the means applying a sequence of temporally spaced pulses provides three temporally spaced pulses, the third pulse having a polarity opposite to the second pulse, and having a lesser amplitude than the second pulse.

5. System according to claim 2, wherein the capacitor (19) is connected directly in parallel to the armature winding (15);

and the controlled switch comprises a thyristor (20) having its main current path connected in series with the primary winding (22*a*) of the ignition transformer, and bridging the capacitor (19) to form a discharge circuit therefor.

6. System according to claim 5, further comprising a voltage-sensitive switching element (26) having one terminal connected to the ignition capacitor (19) and the other to the gate, or trigger electrode (20*a*) of the thyristor.

7. System according to claim 6, wherein the terminal of the voltage-sensitive element (26) connected to the capacitor (19) is further connected to the anode of the thyrister (20), whereby the anode of the thyrister (20) is likewise connected to a terminal of the capacitor (19).

8. System according to claim 6, wherein the voltage-sensitive switching element comprises an avalanche diode (16) and a series connected resistor (27), the cathode of the avalanche diode being connected to the capacitor (19).

9. System according to claim 1, wherein the controlled switch comprises a thyristor (20); and a diode (21) is connected in series with the thyristor and in the discharge circuit for the capacitor.

10. System according to claim 1, wherein the ignition system includes an ignition transformer; and the capacitor (19) is connected in a circuit with the armature winding (15) and the primary winding (22*a*) of the capacitor to form an oscillatory circuit with both said primary winding (22*a*) and said armature winding (15), said primary winding (22*a*) and said armature winding forming, each, part of said inductance means.

11. System according to claim 1, wherein the controlled switch comprises a planar thyristor (20′), and a resistor (28) connecting the gate electrode (20*a′*) *of the planar thyristor with its cathode.*

12. System according to claim 1, wherein the inductance means comprises the armature coil of an a-c generator (14), and E-shaped iron core (16) forming part of said a-c generator, the armature winding (15) being wound on the center leg (16*a*) of the E-shaped core (16), the core being in magnetic circuit relation to a rotary magnet rotating in synchronism with the rotation of the internal combustion engine, the rotary magnet having two pole shoes (13) circumferentially arranged on the rotating field, and located, behind each other, in circumferential direction and spaced to bridge two adjacent legs of the core (16) when the pole shoes are opposite the armature structure of the a-c generator.

13. Method to generate an ignition pulse for internal combustion engines having a charge capacitor, means to charge the capacitor, and means to discharge the capacitor through the primary of an ignition transformer to generate a high-voltage pulse at the secondary thereof, and an inductive means;

comprising the steps of generating a sequence of temporally spaced puses of alternating polarity;

applying said spaced pulses to the inductive means and the capacitor to initiate oscillations, the first oscillatory half-wave resulting from the application of the first generated pulse of the sequence of pulses re-charging the capacitor in the opposite direction and the next generated pulse adding to the charge of the then oppositely pre-charged capacitor;

and discharging the charge of the capacitor forming the composite of said re-charge thereon — due to the first half-wave of oscillation — and the second pulse through the primary of the ignition transformer to generate an ignition pulse in the secondary of the ignition transformer.

14. Method according to claim 13, including the step of continuing to supply electrical energy to the ignition transformer upon discharge of the capacitor therethrough.

15. Method according to claim 13, wherein the step of generating a sequence of temporally spaced pulses comprises generating three pulses of alternating polarity, the third pulse being of lesser amplitude and spaced, in time, from said second pulse approximately by the same interval as the spacing between said first and second pulses.

* * * * *

UNITED STATES PATENT AND TRADEMARK OFFICE

CERTIFICATE OF CORRECTION

PATENT NO. : 3,951,122

DATED : April 20, 1976

INVENTOR(S) : HAUBNER et al

It is certified that error appears in the above-identified patent and that said Letters Patent are hereby corrected as shown below:

CLAIM 2, column 6, line 43, "supply" should be --supplying--;

CLAIM 8, column 7, line 11, "16" should be --26--.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*